US012655527B2

(12) United States Patent
Ono et al.

(10) Patent No.: US 12,655,527 B2
(45) Date of Patent: Jun. 16, 2026

(54) WATER ELECTROLYSIS DEVICE AND METHOD OF CONTROLLING WATER ELECTROLYSIS DEVICE

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Akihiko Ono, Tokyo (JP); Norihiro Yoshinaga, Yokohama (JP); Yoshitsune Sugano, Kawasaki (JP)

(73) Assignees: Kabushilki Kaisha Toshiba, Kawasaki (JP); Toshiba Energy Systems & Solutions Corporation, Kawasaki (JP)

( * ) Notice: Subject to any disclaimer, the term of this patent is extended or adjusted under 35 U.S.C. 154(b) by 267 days.

(21) Appl. No.: 18/460,866

(22) Filed: Sep. 5, 2023

(65) Prior Publication Data

US 2024/0110290 A1 Apr. 4, 2024

(30) Foreign Application Priority Data

Oct. 3, 2022 (JP) ..... 2022-159382

(51) Int. Cl.
*C25B 1/04* (2021.01)
*C25B 9/21* (2021.01)
(Continued)

(52) U.S. Cl.
CPC ..... *C25B 1/04* (2013.01); *C25B 9/21* (2021.01); *C25B 11/081* (2021.01); *C25B 15/029* (2021.01); *C25B 15/08* (2013.01)

(58) Field of Classification Search
CPC .... C25B 1/04; C25B 9/21; C25B 9/23; C25B 11/081; C25B 11/053; C25B 15/029;
(Continued)

(56) References Cited

U.S. PATENT DOCUMENTS 5,651,894 A * 7/1997 Boyce ..... B01D 61/026 210/651
2010/0187129 A1* 7/2010 Sano ..... C02F 1/4618 205/746
(Continued)

FOREIGN PATENT DOCUMENTS

EP 3 964 607 A1 3/2022
EP 4001463 A1 * 5/2022 ..... C25B 1/04
(Continued)

OTHER PUBLICATIONS

Kondo et al., Design of molecular water oxidation catalysts with earth-abundant metal ions, Chem. Soc. Rev., 2021, 50, 6790-6831 (Year: 2021).*
(Continued)

*Primary Examiner* — Shizhi Qian
(74) *Attorney, Agent, or Firm* — Finnegan, Henderson, Farabow, Garrett & Dunner, LLP

(57) ABSTRACT

A water electrolysis device includes: an anode; a cathode; an electrolyte membrane between the anode and the cathode; a first circulation flow path connecting a anode supply flow path and a anode discharge flow path; a second circulation flow path connected in parallel with the first circulation flow path; an ion filter in a middle of the second circulation flow path and to remove metal ions in the anode solution; a metal supply source to supply metal ions into the anode solution; a first valve in a middle of the first circulation flow path; a second valve in a middle of the second circulation flow path; a third valve in a middle of the metal supply flow path; a sensor to measure concentration of metal ions in the anode solution; and a controller to control opening and closing of each valve, according to the measured concentration of the metal ions.

17 Claims, 3 Drawing Sheets

(51) Int. Cl.

| | |
|---|---|
| ***C25B 11/081*** | (2021.01) |
| ***C25B 15/029*** | (2021.01) |
| ***C25B 15/08*** | (2006.01) |

(58) Field of Classification Search
CPC ..... C25B 15/08; C25B 15/02; C25B 15/085; Y02E 60/36
See application file for complete search history.

(56) References Cited

U.S. PATENT DOCUMENTS

| | | | | |
|---|---|---|---|---|
| 2013/0068627 | A1* | 3/2013 | Shodai | C25B 9/00 205/335 |
| 2017/0183788 | A1 | 6/2017 | Iida et al. | |
| 2018/0216243 | A1* | 8/2018 | Kudo | C25B 9/73 |
| 2019/0071784 | A1* | 3/2019 | Yoshinaga | C25B 1/04 |
| 2020/0240023 | A1* | 7/2020 | Cave | C25B 3/07 |
| 2021/0002775 | A1* | 1/2021 | Matsumoto | C25B 11/037 |

FOREIGN PATENT DOCUMENTS

| | | | |
|---|---|---|---|
| JP | 2017-115232 | A | 6/2017 |
| JP | 2019-167620 | A | 10/2019 |
| JP | 6971944 | B2 | 11/2021 |
| JP | 7125021 | B | 8/2022 |

OTHER PUBLICATIONS

Bonke et al., Electrolysis of natural waters contaminated with transition-metal ions: identification of a metastable FePb-based oxygen-evolution catalyst operating weakly acidic solutions, ChemPlusChem, 2018, 83, 704-710 (Year: 2018).*

Tsotridis et al., EU harmonised protocols for testing of low temperature water electrolysis, JRC Technical Report, 2021 (Year: 2021).*

European Patent Office, Extended European Search Report in EP App. No. 23195654.1, 9 pages (Jul. 11, 2024).

Norihiro Yoshinaga et al., "Technologies for Realization of Large MEA with Reduced Amounts of Precious Metals for PEM Water Electrolysis Systems," Toshiba Review, vol. 77, No. 4, pp. 11-14 (2022).

* cited by examiner

WATER ELECTROLYSIS DEVICE AND METHOD OF CONTROLLING WATER ELECTROLYSIS DEVICE

CROSS-REFERENCE TO RELATED APPLICATION

This application is based upon and claims the benefit of priority from Japanese Patent Application No. 2022-159382, filed on Oct. 3, 2022; the entire contents of which are incorporated herein by reference.

FIELD

Embodiments relate to a water electrolysis device and a method of controlling a water electrolysis device.

BACKGROUND

In recent years, electrochemical reaction devices such as water electrolysis devices that convert water into oxygen and hydrogen, has been progressively developed. The water electrolysis devices include, for example, a membrane electrode assembly (MEA) having an anode, a cathode, and an electrolyte membrane. The water electrolysis devices, for example, oxidize water at the anode to produce a hydrogen ion and oxygen, and reduce the hydrogen ion at the cathode to produce hydrogen.

DETAILED DESCRIPTION

Figure 1:
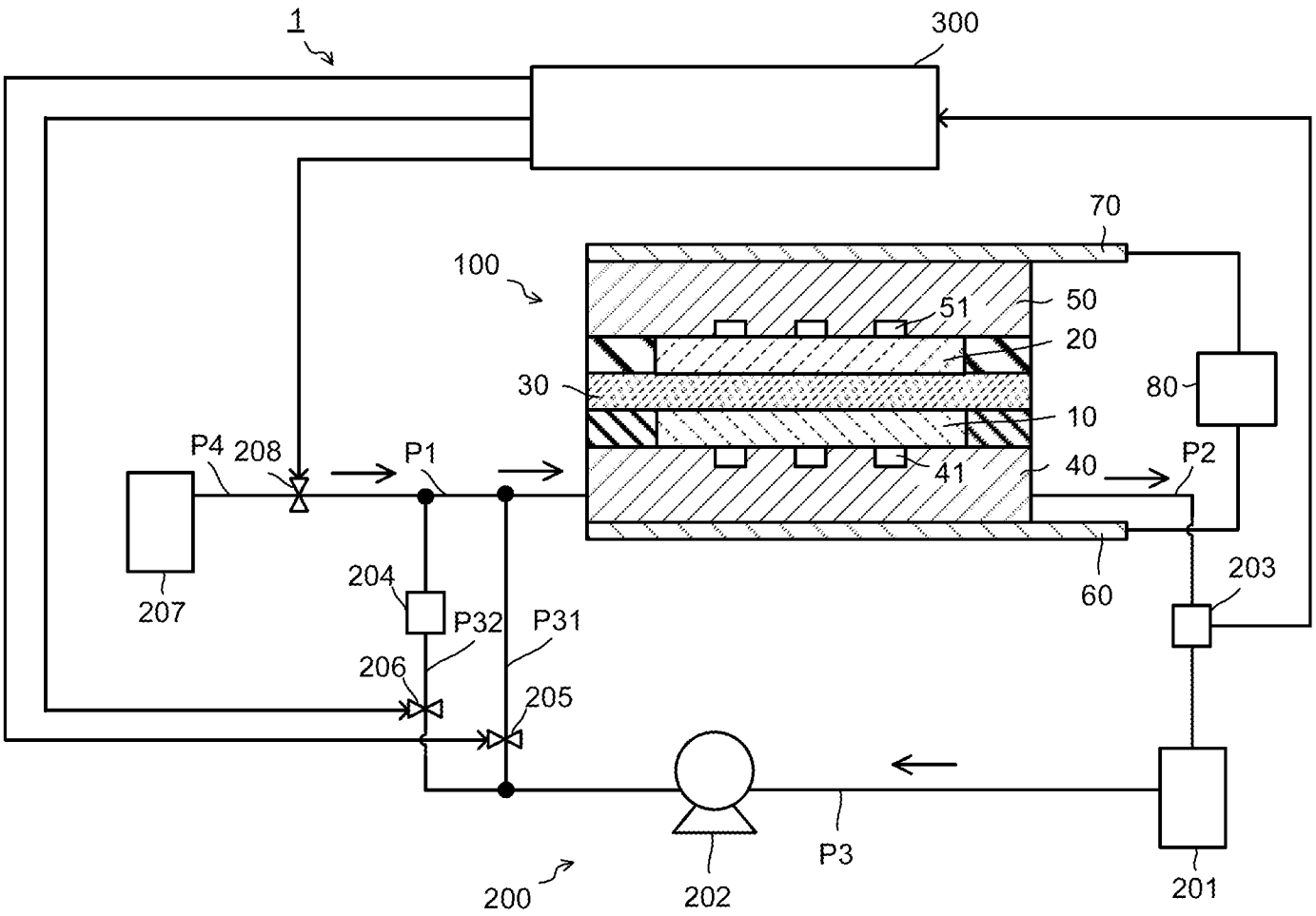
FIG. 1 is a schematic view illustrating an example configuration of a water electrolysis device.

A water electrolysis device in an embodiment, includes: an anode configured to oxidize water to produce oxygen; a cathode configured to reduce a hydrogen ion to produce hydrogen; an anode flow path through which an anode solution containing water and a metal ion flows, the anode flow path facing on the anode and; a cathode flow path facing on the cathode; an electrolyte membrane provided between the anode and the cathode; an anode supply flow path connected to an inlet of the anode flow path; an anode discharge flow path connected to an outlet of the anode flow path; a first circulation flow path connecting the anode supply flow path and the anode discharge flow path; a second circulation flow path connected in parallel with the first circulation flow path; an ion filter provided in a middle of the second circulation flow path and configured to remove some of the metal ions in the anode solution; a metal supply source configured to supply metal ions into the anode solution; a metal supply flow path connecting the metal supply source and the anode supply flow path; a first valve provided in a middle of the first circulation flow path; a second valve provided in a middle of the second circulation flow path; a third valve provided in a middle of the metal supply flow path; a sensor configured to measure a concentration of the metal ions in the anode solution from the anode flow path; and a controller configured to control opening and closing of the first valve, opening and closing of the second valve, and opening and closing of the third valve, according to the measured concentration of the metal ions.

There will be explained an embodiment with reference to the drawings below. In the following embodiment, substantially the same components are denoted by the same reference numerals and symbols, and explanations thereof may be partly omitted. The drawings are schematic, and a relation between thickness and planar dimension, a thickness ratio among parts, and so on may be different from actual ones.

In this specification, "connecting" includes not only directly connecting but also indirectly connecting, unless otherwise specified.

FIG. 1 is a schematic view illustrating an example configuration of a water electrolysis device. A water electrolysis device 1 illustrated in FIG. 1 includes a membrane electrode assembly 100, an anode solution supply system 200, and a controller 300.

The membrane electrode assembly 100 includes an electrode 10, an electrode 20, and an electrolyte membrane 30.

Figure 2:
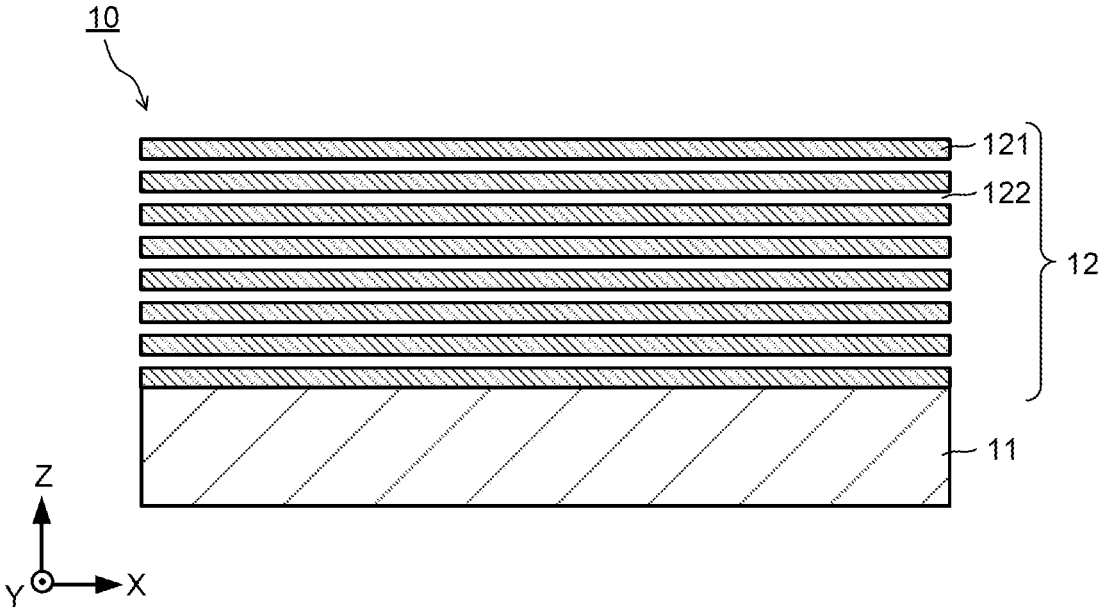
FIG. 2 is a schematic cross-sectional view illustrating an example structure of an example.

FIG. 2 is a schematic cross-sectional view illustrating an example structure of the electrode 10. FIG. 2 illustrates an X-axis, a Y-axis orthogonal to the X-axis, and a Z-axis orthogonal to the X-axis and the Y-axis. FIG. 2 illustrates a part of the X-Z cross section of the electrode 10.

The electrode 10 illustrated in FIG. 2 includes a substrate 11 and a stack 12. The electrode 10 has a function as an anode of the water electrolysis device.

The substrate 11, for example, can be made using one or more of carbon materials such as carbon cloth and carbon paper, or one or more of metal materials such as titanium (Ti), nickel (Ni), and iron (Fe) and alloys containing at least one of these metals such as SUS. The substrate 11 may be a mesh substrate or porous substrate with these materials.

The stack 12 is provided on the substrate 11. The stack 12 includes a catalyst layer 121 and a gap layer 122. FIG. 2 illustrates a plurality of the catalyst layers 121 and a plurality of the gap layers 122. Each catalyst layers 121 and each gap layers 122 are alternately stacked on the substrate 11. The catalyst layers 121 may be partially joined together at one or more ends of each of the catalyst layers 121 in at least one of the X-axis direction and the Y-axis direction. This can prevent deformation of the stack 12 caused by pressure in the stacking direction. Further, the stack 12 may include at least one catalyst pillar connecting two or more of the catalyst layers 121. This can prevent peeling of the catalyst layer 121.

The catalyst layer 121 includes an anode catalyst that promotes oxidation of an oxidizable material (a material to be oxidized). The number of the catalyst layers 121 is not particularly limited, and is, for example, 5 or more and 20 or less. The thickness of the catalyst layer 121 is, for example, 4 nm or more and 50 nm or less.

The anode catalyst, for example, contains at least one noble metal or oxide thereof. The at least one noble metal, for example, includes at least one of platinum (Pt), palladium (Pd), iridium (Ir), ruthenium (Ru), rhodium (Rh), osmium (Os), gold (Au), and tantalum (Ta). The anode catalyst may contain a plurality of these catalyst materials. In the case of the water electrolysis device, the anode catalyst is, for example, a material that promotes an oxidation reaction of water.

The gap layer 122 is provided between two of the catalyst layers 121. The gap layer 122 forms a space. The average thickness of the gap layer 122 is, for example, 1 nm or more and 100 nm or less.

The average thickness of the stack 12 is, for example, 10 nm or more and 900 nm or less. When the thickness is less than 10 nm, the amount of catalyst is small and the reaction efficiency decreases. When the thickness exceeds 900 nm, the diffusibility deteriorates, and the performance of supplying water to the catalyst layer 121 or the performance of discharging an oxygen gas deteriorates, resulting in a decrease in the performance.

The dimensions and composition of the substrate 11, the catalyst layer 121, and the gap layer 122 can be measured using, for example, a scanning electron microscope (SEM), an X-ray fluorescence analysis (XRF), elemental mapping by a transmission electron microscope (TEM), TEM high-angle annular dark-field (HAADF), and an energy dispersive X-ray spectroscopy (EDS) line analysis.

Figure 3:
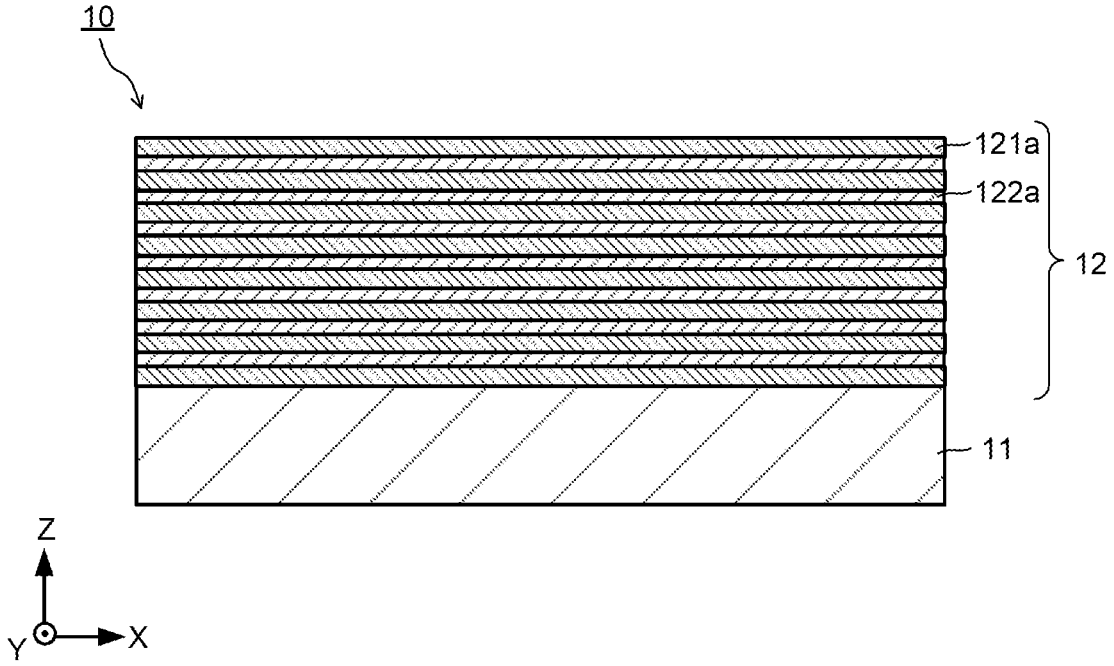
FIG. 3 is a schematic cross-sectional view for explaining an example of a method of forming a stack.

FIG. 3 is a schematic cross-sectional view for explaining an example of a method of forming the stack 12. As illustrated in FIG. 3, the stack 12 can be formed by alternately forming a precursor layer 121*a* of the catalyst layer 121 and a pore former layer (a pore-forming material layer) 122*a* using sputtering, and then removing the pore former layers 122*a* with the precursor layers 121*a* remaining. This method allows for control of the thicknesses of the catalyst layer 121 and the pore former layer 122*a* on the order of nanometers, and further facilitates control of the composition or the oxidation state, and therefore it is possible to improve the degree of freedom in the design of the catalyst layer 121.

The precursor layer 121*a* contains an anode catalyst. When the precursor layer 121*a* is amorphous, a crystal structure may be oriented by performing a heat treatment. When a catalyst containing an iridium oxide is used, reactive sputtering is preferred in which an oxygen gas is added into a chamber of a sputtering apparatus.

The pore former layer 122*a* contains a pore former. Examples of the pore former include at least one non-noble metal or oxide thereof. Examples of the non-noble metal include iron (Fe), cobalt (Co), nickel (Ni), manganese (Mn), aluminum (Al), zinc (Zn), tantalum (Ta), tungsten (W), hafnium (Hf), silicon (Si), molybdenum (Mo), titanium (Ti), zirconium (Zr), niobium (Nb), vanadium (V), chromium (Cr), tin (Sn), and strontium (Sr). Further, the pore former layers 122*a* can be removed by selective etching using chemicals such as acid or alkali, for example, with the catalyst layers 121 remaining. A heat treatment may be performed to promote melting of the pore former layers 122*a*.

The pore former may also be contained in the precursor layer 121*a*. The precursor layer 121*a* containing the pore former can be formed by performing sputtering using a mixed sputtering target containing a raw material of the precursor layer 121*a* and a raw material of the pore former. Thereby, the pore former in the precursor layer 121*a* is also removed by selective etching, to make the catalyst layer 121 porous. Therefore, the surface area of the catalyst layer 121 can be increased.

The substrate 11 of the electrode 10 faces on an anode flow path 41 through which an anode solution flows. The stack 12 of the electrode 10 faces on the electrolyte membrane 30. The anode flow path 41 has grooves provided in the surface of an anode flow path plate 40. The anode flow path 41 has an inlet and an outlet, which are not illustrated. The inlet of the anode flow path 41 is connected to an anode supply flow path P1. The outlet of the anode flow path 41 is connected to an anode discharge flow path P2. The shape of the anode flow path 41 is not limited in particular, but may have a serpentine shape along the surface of the anode flow path plate 40, for example.

The electrode 20 has a function as a cathode of the water electrolysis device. The electrode 20 includes a cathode catalyst that promotes reduction of a reducible material (a material to be reduced). Examples of the cathode catalyst include metals such as platinum (Pt), iron (Fe), calcium (Ca), iridium (Ir), and ruthenium (Ru), or oxides thereof. The cathode catalyst is formed as a cathode catalyst layer on a substrate, for example. The substrate can be formed using a material applicable to the substrate 11 of the electrode 10. A particulate cathode catalyst may be mixed with a binder made of a proton-conducting organic material to form the cathode catalyst layer. Examples of the binder include polyvinyl alcohol (PVA).

The substrate of the electrode 20 faces on a cathode flow path 51. The cathode catalyst layer of the electrode 20 faces on the electrolyte membrane 30. The cathode flow path 51 has grooves provided on the surface of a cathode flow path plate 50. The cathode flow path 51 has an outlet, which is not illustrated. For example, the outlet of the cathode flow path 51 is connected to a product collector, which is not illustrated. The shape of the cathode flow path 51 is not limited, and may have a serpentine shape along the surface of the cathode flow path 51, for example.

The electrolyte membrane 30 is provided between the electrode 10 and the electrode 20. The electrolyte membrane 30 can be made of a membrane such as an ion exchange membrane that allows ions to move between the electrode 10 and the electrode 20, for example. Examples of the ion exchange membrane include a cation exchange membrane such as Nafion or Flemion. The electrolyte membrane 30 may be impregnated with part of the catalyst layers of the electrode 10 and the electrode 20. This impregnation can increase the adhesion between the electrode 10 and the electrolyte membrane 30 and the adhesion between the electrode 20 and the electrolyte membrane 30.

The electrode 10 and the electrode 20 are electrically connected to an anode current collector 60 and a cathode current collector 70, respectively. Each of the anode current collector 60 and the cathode current collector 70 is electrically connected to a power supply 80 via a current introduction member such as a wiring. The power supply 80 is not limited to a power source such as a normal system power supply or a battery, and may have a power source that supplies power generated by renewable energy such as photovoltaics or wind power generation. The power supply 80 may include the power source and a power controller that adjusts the output of the power source to control the voltage between the electrode 10 and the electrode 20.

The electrode 10, the electrode 20, the electrolyte membrane 30, the anode flow path plate 40, the cathode flow path plate 50, the anode current collector 60, and the cathode current collector 70 may be stacked to each other, This stack is also called an electrolysis cell. The stack may be provided between supporting plates, which are not illustrated, and may be tightened with bolts or the like.

The anode solution supply system 200 includes an anode solution container 201, a flow rate controller 202, a concentration sensor 203, an ion filter 204, a valve 205, a valve 206, a metal supply source 207, a valve 208, a circulation flow path P3, and a metal supply flow path P4, and is configured so that the anode solution circulates through the anode supply flow path P1, the anode flow path 41, the anode discharge flow path P2, and the circulation flow path P3. The anode solution supply system 200 connects the anode supply flow path P1 and the anode discharge flow path P2 via the circulation flow path P3. The water electrolysis device 1 may have at least one selected from a valve or a pump in the middle of the anode supply flow path P1, in the middle of the anode discharge flow path P2, and/or in the middle of the circulation flow path P3 to control the pressure of each flow path or the flow rate of a fluid flowing through the corresponding flow path.

The anode solution container 201 includes a tank that stores a fluid containing the anode solution to be discharged from the outlet of the anode flow path 41 through the anode discharge flow path P2 (also referred to as an anode discharge liquid). The flow rate controller 202 is provided in the middle of at least one of the anode supply flow path P1, the anode discharge flow path P2, and the circulation flow path P3, and controls the flow rate of the anode solution. The anode solution is introduced to the anode flow path 41 through the anode supply flow path P1. The water electrolysis device 1 may have a pressure controller provided in the middle of at least one of the anode supply flow path P1, the anode discharge flow path P2, and the circulation flow path P3 to control the pressure of the anode flow path 41. The anode solution container 201 may be connected to an anode solution supply source, which is not illustrated, and the anode solution container 201 may be replenished with the anode solution from the anode solution supply source.

The anode solution is preferably a solution containing at least water ($H_2O$). The anode solution may be, for example, ultrapure water.

When the anode solution contains water, the performance of the water electrolysis device may deteriorate if the oxidation reaction of water continues. Therefore, the anode solution in this embodiment further contains at least one metal ion. The at least one metal ion, for example, includes at least one divalent ion selected from a nickel ion, an iron ion, a cobalt ion, and a manganese ion. The presence of the at least one metal ion in the anode solution can promote the oxidation of the anode solution. Further, the presence of the ions increases the conductive performance in the anode solution and reduces the cell resistance, thus lowering the cell voltage and improving the performance. The concentration of the at least one metal ions in the anode solution is preferably adjusted to 0.05 μmol/l or more and 0.5 μmol/l or less. When the concentration of the at least one metal ions is less than 0.05 μmol/l, the oxidizing effect of the anode solution is poor, so that the cell performance is not improved. When the concentration of the at least one metal ions exceeds 0.5 μmol/l, the at least one metal ions adhere to the electrolyte membrane 30 and the performance of ion movement deteriorates, resulting in a decrease in the performance. The anode solution preferably has a lower concentration of any metal ions different from the nickel ions than the nickel ion concentration.

The concentration sensor 203 is provided in the middle of the anode discharge flow path P2 or connected to the anode discharge flow path P2, for example. The concentration sensor 203 can detect the concentration of the at least one metal ions in the anode solution discharged from the anode flow path 41 and sends a detection signal having the detected concentration data to the controller 300. Examples of the concentration sensor 203 include a high-frequency inductively coupled plasma (ICP) emission spectroscopy sensor and ion chromatograph. The examples of the concentration sensor 203 is not limited to this examples, and the concentration sensor 203 may calculates the concentration from one or more results measured by an ion concentration meter, an absorbance sensor, or a conductivity meter. The water electrolysis device preferably inhibits mixture of other ions different from metal ions such as nickel ions from within the system as much as possible. Therefore, when the concentration sensor 203 is provided in-line in the device for measurement, the use of the conductivity meter for calculating the concentration can save the cost of the device.

The circulation flow path P3 branches into a circulation flow path P31 and a circulation flow path P32. The circulation flow path P31 and the circulation flow path P32 are connected in parallel with each other. The circulation flow path P31 is connected to the anode supply flow path P1 without the ion filter 204 being provided therebetween. The circulation flow path P32 is connected to the anode supply flow path P1 via the ion filter 204.

The ion filter 204 is provided in the middle of the circulation flow path P32. The ion filter 204 can remove some of at least one metal ions in the anode solution. Examples of the ion filter 204 include filters using ion exchange resins, filters using reverse osmosis membranes (RO membranes), and filters made of combinations of activated carbon and ion exchange resins.

The valve 205 is provided in the middle of the circulation flow path P31. The valve 206 is provided in the middle of the circulation flow path P32 and is provided to precede to the ion filter 204. The opening and closing of the valve 205 and the opening and closing of the valve 206 are controlled by control signals from the controller 300.

The metal supply source 207 is connected to the anode supply flow path P1 via the metal supply flow path P4. The metal supply source 207 can supply the at least one metal ions to the anode solution. The metal supply source 207 may supply water containing the at least one metal ions to the anode supply flow path P1, the water containing the at least one metal 1 ions having a concentration higher than the concentration of the at least one metal in the anode solution, the at least one metal being selected from nickel, iron, cobalt, and manganese. The metal supply source 207 may supply water containing the nickel ions to the anode supply flow path P1, the water containing the nickel ions having a concentration higher than the concentration of nickel.

The valve 208 is provided in the middle of the metal supply flow path P4. The opening and closing of the valve 208 are controlled by a control signal from the controller 300.

The controller 300 can send control signals to control the openings and closings of the valves 205, 206, and 208 respectively to the valves 205, 206, and 208 in response to detection signals from the concentration sensor 203. This can adjust the concentration of the at least one metal ions in the anode solution within a predetermined range.

The controller 300 may be configured using hardware using a processor or the like, for example. Each operation may be stored as an operation program in a computer-readable recording medium such as a memory, and each operation may be executed by appropriately reading out the operation program stored in the recording medium by hardware.

Next, there is explained a method of controlling the water electrolysis device. When performing electrolysis with the water electrolysis device, the valve 205 is opened and the valve 206 and the valve 208 are closed based on the control signals from the controller 300. Thereby, the anode solution is supplied to the anode flow path 41 through the anode supply flow path P1, and the power supply 80 applies a voltage between the electrode 10 and the electrode 20 to supply current. The anode solution is supplied to the electrode 10. When a current is applied between the electrode 10 and the electrode 20, an oxidation reaction near the electrode 10 and a reduction reaction near the electrode 20 occur as described below. The case where water is oxidized to produce a hydrogen ion and the hydrogen ion is reduced to produce hydrogen is explained here, but other side reactions may also occur.

There is explained a reaction process in the case where water ($H_2O$) is oxidized to produce a hydrogen ion ($H^+$). When the power supply 80 supplies a current between the electrode 10 and the electrode 20, an oxidation reaction of water ($H_2O$) occurs at the electrode 10 in contact with the anode solution. Specifically, as expressed in Expression (1) below, $H_2O$ contained in the anode solution is oxidized to produce oxygen ($O_2$), a hydrogen ion ($H^+$), and an electron ($e^-$). The oxygen produced at the electrode 10 is discharged to the outside of the electrode 10 through the gap layer 122. The discharged oxygen may be collected by an anode product collector, which is not illustrated.

$$2H_2O \rightarrow 4H^+ + O_2 + 4e^- \quad (1)$$

$H^+$ produced at the electrode 10 moves through the anode solution present in the electrode 10 and the electrolyte membrane 30 and reaches the vicinity of the electrode 20. The electron ($e^-$) based on the current supplied from the power supply 80 to the electrode 20 and $H^+$ that has moved to the vicinity of the electrode 20 cause a reduction reaction of the hydrogen ion. Specifically, as expressed in Expression (2) below, the hydrogen ion is reduced to produce hydrogen. The hydrogen produced at the electrode 20 is discharged from the outlet of the cathode flow path 51. The discharged hydrogen may be collected by a cathode product collector, which is not illustrated.

$$4H^+ + 4e^- \rightarrow 2H_2 \quad (2)$$

Here, there is explained a method of adjusting the concentration of the at least one metal ions in the anode solution.

When the measured concentration of the at least one metal ions discharged from the anode flow path 41 is lower than 0.05 μmol/l, the valve 206 is closed based on the control signals from the controller 300 and the valve 205 and the valve 208 are opened based on the control signals from the controller 300, in a first operation. This operation enables the anode solution to flow through the circulation flow path P31, and the at least one metal ions to be supplied to the anode solution from the metal supply source 207 through the metal supply flow path P4 until the measured concentration of the at least one metal ions discharged from the anode flow path 41 falls within a range of 0.05 μmol/l or more and 0.5 μmol/l or less. During the first operation, the application of the voltage may be stopped.

When the measured concentration of the at least one metal ions discharged from the anode flow path 41 is higher than 0.5 μmol/l, the valve 205 and the valve 208 are closed based on the control signals from the controller 300 and the valve 206 is opened based on the control signals from the controller 300, in a second operation. This operation enables the anode solution to flow through the circulation flow path P32, and the at least one metal ions in the anode solution to be removed by the ion filter 204 until the measured concentration of the at least one metal ions discharged from the anode flow path 41 falls within a range of 0.05 μmol/l or more and 0.5 μmol/l or less. During the second operation, the application of the voltage may be stopped.

When the measured concentration of the at least one metal ions discharged from the anode flow path 41 is within the range of 0.05 μmol/l or more and 0.5 μmol/l or less, the valve 206 and the valve 208 are closed based on the control signals from the controller 300, in a third operation and the valve 205 is opened based on the control signals from the controller 300, in a third operation. This operation enables the anode solution to flow through the circulation flow path P31 to be supplied to the anode flow path 41 through the anode supply flow path P1, and the electrolysis operation to be continued.

These explanations show the example of the method of controlling the water electrolysis device. The water electrolysis device in this embodiment, can control the concentration of the at least one metal ions in the anode solution to fall within a predetermined range, to thus improve the performance of the water electrolysis device.

The catalyst layer 121 may contain at least one metal selected from nickel, iron, cobalt, and manganese. For example, the catalyst layer 121 can be formed by adding the at least one metal to the precursor layer 121*a* of the catalyst layer 121 and dissolving the pore former layer 122*a* under the conditions that the at least one metal in the catalyst layer 121 remains by selective etching using agents such as acid or alkali, for example. The amount of the at least one metal remaining in the catalyst layer 121 can be adjusted to 0.072 or more and 0.293 or less by mass ratio with respect to a noble metal such as iridium, the at least one metal can be left without performing selective etching a plurality of times, resulting in that the formation process can be simplified.

Figure 4:
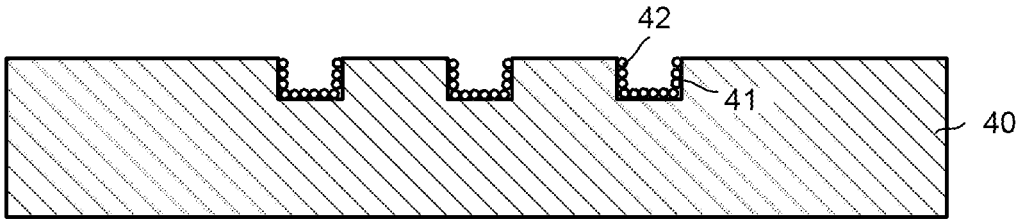
FIG. 4 is a schematic cross-sectional view illustrating another example of an anode flow path plate.

The configuration of the anode flow path plate 40 is not limited to the configuration illustrated in FIG. 1. FIG. 4 is a schematic cross-sectional view illustrating another example embodiment of the anode flow path plate 40. The anode flow path plate 40 illustrated in FIG. 4 includes a catalyst layer 42 containing at least one metal on the inner surface of grooves defining the anode flow path 41. The at least one metal is selected from nickel, iron, cobalt, and manganese.

The catalyst layer 42 is formed, for example, by making particulate the at least one metal 1 adhere to the inner surface of the grooves defining the anode flow path 41. Examples of the adhesion method include a method that includes spraying the at least one metal onto the flow path with a spray, and a method that includes mixing particulate the at least one metal with an organic adhesive for easy adhesion and spraying the mixture onto the inner surface. Examples of the adhesive include organics such as polyvinyl alcohol (PVA). Further, the catalyst layer 42 may be preferably made using an ion-exchange resin such as Nafion in order to promote the movement of ions. Example methods of supporting the at least one metal only in the grooves include a method that includes introducing an ink containing the at least one metal and an ion-exchange resin to the anode flow path 41, and then drying and/or heating the object to form the catalyst layer 42 only on the inner surface of the grooves defining the anode flow path 41. The anode flow path 41 may have an uneven surface on the inner surface of the grooves defining the anode flow path 41 to facilitate adhesion of the at least one metal The formation of the catalyst layer 42 enables the oxidation reaction similar to the oxidation reaction at the electrode 10 in also the anode flow path 41. This can inhibit the deterioration of the performance of the water electrolysis device.

The continuation of electrolysis operation may cause the at least one metal of the catalyst layer 42 to be gradually peeled off from the anode flow path plate 40. This case enables the at least one metal to remain as the at least one metal ions in the anode solution, and thus inhibit the decrease in the concentration of the at least one metal ions in the anode solution. Furthermore, when the measured concentration of the at least one metal ions in the anode solution is larger than 0.5 μmol/l due to the peeling of the at least one metal from the catalyst layer 42, the concentration of the at least one metal ions can be reduced by the method to adjust the concentration of the at least one metal ions in the anode solution to 0.05 μmol/l or more and 0.5 μmol/l or less.

EXAMPLES

Example 1

A water electrolysis device having the electrolysis cell illustrated in FIG. 1 was manufactured. As for the electrode 10, the catalyst layer 121 and the gap layer 122 were formed by alternately sputtering iridium and nickel on a titanium nonwoven fabric and etching the nickel with acid. The number of layers of the catalyst layer 121 was 3 to 20. The electrode 20 was formed by applying a carbon-supported platinum catalyst to a gas diffusion layer. The electrolyte membrane 30 was Nafion. The anode flow path plate 40 and the cathode flow path plate 50 were formed by cutting titanium. The anode current collector 60 and the cathode current collector 70 were formed by plating a titanium plate with gold. These members were stacked, sandwiched between support plates, which are not illustrated, and further tightened with bolts.

In the electrolysis device in Example 1, the temperature of the electrolysis cell was set to 80° C., and an electrolysis operation was continuously performed at a current density of 2 A/cm$^2$ while supplying water having a nickel ion concentration of 0.05 μmol/l as an anode solution to the anode flow path 41. The voltage between the electrode 10 and the electrode 20 (the voltage across the electrolysis cell) was measured 48 hours after the start of the electrolysis operation, and then the voltage was 1.840 V. Further, the conductivity of the anode solution was 0.05 μS/cm. The result is illustrated in Table 1.

Example 2

The water electrolysis device was used as in Example 1, and an electrolysis operation was performed under the same conditions as in Example 1, except that the concentration of the nickel ions in the anode solution was 0.1 μmol/l. Further, the voltage across the electrolysis cell was measured by the same method as in that of Example 1, and then the voltage was 1.830 V. Further, the conductivity of the anode solution was 0.05 μS/cm. The result is illustrated in Table 1.

Example 3

The water electrolysis device was used as in Example 1, and an electrolysis operation was performed under the same conditions as in Example 1, except that the concentration of the nickel ions in the anode solution was 0.5 μmol/l. Further, the voltage across the electrolysis cell was measured by the same method as in Example 1, and then the voltage was 1.825 V. Further, the conductivity of the anode solution was 0.06 μS/cm. The result is illustrated in Table 1.

In Example 3, variations in the nickel ion concentration, variations in the electrolysis cell voltage, and variations in the anode solution conductivity were each further evaluated with the passage of time in the electrolysis operation. The results are illustrated in Table 2.

Comparative Example 1

The water electrolysis device was used as in Example 1, and an electrolysis operation was performed under the same conditions as in Example 1, except that the concentration of the nickel ions in the anode solution was 0 μmol/l. Further, the voltage across the electrolysis cell was measured by the same method as in Example 1, and then the voltage was 1.845 V. Further, the conductivity of the anode solution was 0.03 μS/cm. The result is illustrated in Table 1.

Comparative Example 1

The water electrolysis device was used as in Example 1, and an electrolysis operation was performed under the same conditions as in Example 1, except that the concentration of the nickel ions in the anode solution was 0 μmol/l. Further, the voltage across the electrolysis cell was measured by the same method as in Example 1, and then the voltage was 1.845 V. Further, the conductivity of the anode solution was 0.03 μS/cm. The result is illustrated in Table 1.

Comparative Example 2

The water electrolysis device was used as in Example 1, and an electrolysis operation was performed under the same conditions as in Example 1, except that the concentration of the nickel ions in the anode solution was 1 μmol/l. Further, the voltage across the electrolysis cell was measured by the same method as in Example 1, and then the voltage was 1.85 V. Further, the conductivity of the anode solution was 0.1 μS/cm. The result is illustrated in Table 1.

TABLE 1

| | Exam. 1 | Exam. 2 | Exam. 3 | Comp. Exam. 1 | Comp. Exam. 2 |
|---|---|---|---|---|---|
| Ni ion concentration (μmol/l) | 0.05 | 0.1 | 0.5 | 0 | 1.0 |
| Voltage (V) | 1.840 | 1.830 | 1.825 | 1.845 | 1.850 |
| Current density (A/cm$^2$) | 2 | 2 | 2 | 2 | 2 |
| Conductivity (μS/cm) | 0.05 | 0.05 | 0.06 | 0.03 | 0.1 |

TABLE 2

| Operating time (h) | 0 | 1000 | 2000 | 3000 | 10000 |
|---|---|---|---|---|---|
| Ni ion concentration (μmol/l) | 0.5 | 0.28 | 0.15 | 0.05 | 0 |
| Voltage (V) | 1.825 | 1.825 | 1.832 | 1.840 | 1.850 |
| Current density (A/cm$^2$) | 2 | 2 | 2 | 2 | 2 |
| Conductivity (μS/cm) | 0.06 | 0.05 | 0.05 | 0.05 | 0.03 |

The results of Examples 1 to 3 and Comparative examples 1 and 2 reveal that the control of the concentration of the nickel ions in the anode solution to 0.05 μmol/l or more and 0.5 μmol/l or less can inhibit the increase in cell voltage. This can inhibit the deterioration of the performance of the water electrolysis device. The voltage across the electrolysis cell is preferably, for example, 1.23 V or more and less than 1.85 V and more preferably 1.23 V or more and 1.84 V or less. Further, the results in Table 2 reveal that as the operating time increases, the Ni ion concentration decreases and the voltage increases. Therefore, the increase in voltage can be inhibited by measuring and adjusting the Ni ion concentration to 0.05 μmol/l or more and 0.5 μmol/l or less, as in the electrolysis device in the embodiment. Further, the anode solution preferably has a conductivity of 0.05 μS/cm or more and 0.7 μS/cm or less.

The configurations of the embodiments can be employed in combination or can be partly replaced. While certain embodiments of the present invention have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The embodiment can be summarized into the following clauses.

(Clause 1)

A water electrolysis device comprising:

an anode configured to oxidize water to produce oxygen;

a cathode configured to reduce a hydrogen ion to produce hydrogen;

an anode flow path through which an anode solution containing water and a metal ion flows, the anode flow path facing on the anode;

a cathode flow path facing on the cathode;

an electrolyte membrane provided between the anode and the cathode;

an anode supply flow path connected to an inlet of the anode flow path;

an anode discharge flow path connected to an outlet of the anode flow path;

a first circulation flow path connecting the anode supply flow path and the anode discharge flow path;

a second circulation flow path connected in parallel with the first circulation flow path;

an ion filter provided in a middle of the second circulation flow path and configured to remove some of the metal ions in the anode solution;

a metal supply source configured to supply the metal ions into the anode solution;

a metal supply flow path connecting the metal supply source and the anode supply flow path;

a first valve provided in a middle of the first circulation flow path;

a second valve provided in a middle of the second circulation flow path;

a third valve provided in a middle of the metal supply flow path;

a sensor configured to measure the concentration of metal ions in the anode solution from the anode flow path; and a controller configured to control opening and closing of the first valve, opening and closing of the second valve, and opening and closing of the third valve according to the measured concentration of the metal ions.

(Clause 2)

The device according to clause 1, wherein the controller is configured to control a first operation to open the first valve and the third valve and close the second valve when the measured concentration of the metal ions is less than 0.05 μmol/l, a second operation to open the second valve and close the first valve and the third valve when the measured concentration of the metal ions exceeds 0.5 μmol/l, and a third operation to open the first valve and close the second valve and the third valve when the measured concentration of the metal ions is 0.05 μmol/l or more and 0.5 μmol/l or less.

(Clause 3)

The device according to clause 1 or clause 2, wherein the anode has a first anode catalyst layer containing metal.

(Clause 4)

The device according to any one of clause 1 to clause 3, further comprising;

an anode flow path plate having the anode flow path, wherein the anode flow path plate having a second anode catalyst layer containing metal on an inner surface of the anode flow path.

(Clause 5)

The device according to any one of clause 1 to clause 4, wherein the anode solution has a conductivity of 0.05 μS/cm or more and 0.7 μS/cm or less.

(Clause 6)

The device according to any one of clause 1 to clause 5, wherein the concentration of the metal ions in the anode solution is adjusted to fall within a range of 0.05 μmol/l or more and 0.5 μmol/l or less.

(Clause 7)

The device according to clause 3 or clause 4, wherein the metal is at least one metal selected from the group consisting of nickel, iron, cobalt, and manganese.

(Clause 8)

The device according to any one of clause 1 to clause 7, wherein the metal ion is at least one divalent ion selected from the group consisting of a nickel ion, an iron ion, a cobalt ion, and a manganese ion.

(Clause 9)

The device according to any one of clause 1 to clause 8, wherein the anode has:

a substrate: and a stack having catalyst layers and gap layers, each catalyst layer and each gap layer being alternatively stacked on the substrate, the catalyst layers being partly joined together.

(Clause 10)

The device according to any one of clause 1 to clause 9, wherein the sensor includes a high-frequency inductively coupled plasma emission spectroscopy sensor, an ion chromatograph, an ion concentration meter, an absorbance sensor, or a conductivity meter.

(Clause 11)

The device according to any one of clause 1 to clause 10, wherein the ion filter includes a filter having a reverse osmosis membrane or a filter having a activated carbon and an ion exchange resin.

(Clause 12)

The device according to any one of clause 1 to clause 11, wherein any metal ions except nickel ions in the anode solution have a concentration lower than the concentration of the nickel ions in the anode solution.

(Clause 13)

A method of controlling a water electrolysis device, the water electrolysis device comprising:

an anode configured to oxidize water to produce oxygen;

a cathode configured to reduce a hydrogen ion to produce hydrogen;

an anode flow path through which an anode solution containing water and a metal ion flows, the anode flow path facing on the anode;

a cathode flow path facing on the cathode;

an electrolyte membrane provided between the anode and the cathode;

an anode supply flow path connected to an inlet of the anode flow path;

an anode discharge flow path connected to an outlet of the anode flow path;

a first circulation flow path connecting the anode supply flow path and the anode discharge flow path;

a second circulation flow path connected in parallel with the first circulation flow path;

an ion filter provided in a middle of the second circulation flow path and configured to remove some of the metal ions in the anode solution;

a metal supply source configured to supply metal ions to the anode solution;

a metal supply flow path connecting the metal supply source and the anode supply flow path;

a first valve provided in a middle of the first circulation flow path;

a second valve provided in a middle of the second circulation flow path; and a third valve provided in a middle of the metal supply flow path;

the method comprising:

measuring a concentration of the metal ions in the anode solution from the anode flow path; and controlling opening and closing of the first valve, opening and closing of the second valve, and opening and closing of the third valve according to the measured concentration of the metal ions.

(Clause 14)

The method according to clause 13, further comprising;

opening the first valve and the third valve and closing the second valve when the measured concentration of the metal ions is less than 0.05 μmol/l;

opening the second valve and closing the first valve and the third valve when the measured concentration of the metal ions is larger than 0.5 μmol/l; and opening the first valve and closing the second valve and the third valve when the measured concentration of the metal ions is 0.05 μmol/l or more and 0.5 μmol/l or less.

(Clause 15)

The method according to clause 13 or clause 14, further comprising:

controlling the opening and closing of the first valve, the opening and closing of the second valve, and the opening and closing of the third valve, to adjust the concentration of the metal ions in the anode solution to fall within a range of 0.05 μmol/l or more and 0.5 μmol/l or less.

(Clause 16)

The method according to any one of clause 13 to clause 15, further comprising supplying the anode solution to the anode flow path and applying a voltage between the cathode and the anode, to oxidize the water and thus produce the hydrogen ion and to reduce the hydrogen ion and thus produce the hydrogen, wherein when the measured concentration of the metal ions is less than 0.05 μmol/l, the application of the voltage is stopped, when the measured concentration of the metal ions is larger than 0.5 μmol/l, the application of the voltage is stopped, and when the measured concentration of the metal ions is 0.05 μmol/l or more and 0.5 μmol/l or less, the application of the voltage is continued.

(Clause 17)

The method according to any one of clause 13 to clause 16, wherein the anode solution has a conductivity of 0.05 μS/cm or more and 0.7 μS/cm or less.

(Clause 18)

The method according to any one of clause 13 to clause 17, wherein the metal ion is at least one divalent ion selected from the group consisting of a nickel ion, an iron ion, a cobalt ion, and a manganese ion.

(Clause 19)

A water electrolysis device comprising:

a membrane electrode assembly comprising an anode configured to oxidize water to produce oxygen, the anode containing iridium, a cathode configured to reduce a hydrogen ion to produce hydrogen, the cathode containing platinum, and an electrolyte membrane provided between the anode and the cathode;

an anode flow path through which an anode solution containing water and a at least one metal ion flows, the anode flow path facing on the anode, and the at least one metal ion being selected from the group consisting of a nickel ion, an iron ion, a cobalt ion, and a manganese ion;

a cathode flow path facing on the cathode;

an anode supply flow path connected to an inlet of the anode flow path;

an anode discharge flow path connected to an outlet of the anode flow path;

a first circulation flow path connecting the anode supply flow path and the anode discharge flow path;

a second circulation flow path connected in parallel with the first circulation flow path;

an ion filter provided in a middle of the second circulation flow path and configured to remove some of the at least one metal ions in the anode solution;

a metal supply source configured to supply the at least one metal ions into the anode solution;

a metal supply flow path connecting the metal supply source and the anode supply flow path;

a first valve provided in a middle of the first circulation flow path;

a second valve provided in a middle of the second circulation flow path;

a third valve provided in a middle of the metal supply flow path;

a sensor configured to measure a concentration of the at least one metal ions in the anode solution from the anode flow path; and a controller configured to control opening and closing of the first valve, opening and closing of the second valve, and opening and closing of the third valve, according to the measured concentration of the at least one metal ions.

(Clause 20)

The device according to clause 19, wherein the controller is configured to control a first operation of opening the first valve and the third valve and closing the second valve when the measured concentration of the at least one metal ions is less than 0.05 μmol/l, a second operation of opening the second valve and closing the first valve and the third valve when the measured concentration of the at least one metal ions exceeds 0.5 μmol/l, and a third operation of opening the first valve and closing the second valve and the third valve when the measured concentration of the at least one metal ions is 0.05 μmol/l or more and 0.5 μmol/l or less.

(Clause 21)

The device according to clause 19 or clause 20, wherein the anode has a first anode catalyst layer containing metal.

(Clause 22)

The device according to clause 21, wherein the metal is at least one metal selected from the group consisting of nickel, iron, cobalt, and manganese.

(Clause 23)

The device according to any one of clause 19 to clause 22, further comprising;

an anode flow path plate having the anode flow path, wherein the anode flow path plate having a second anode catalyst layer containing metal on an inner surface of the anode flow path.

(Clause 24)

The device according to any one of clause 19 to clause 23, wherein the anode has:

a substrate: and a stack having catalyst layers and gap layers, each catalyst layer and each gap layer being alternatively stacked on the substrate, the catalyst layers being partly joined together, each catalyst layer containing iridium.

What is claimed is:

1. A water electrolysis device comprising:

an anode configured to oxidize water to produce oxygen;

a cathode configured to reduce a hydrogen ion to produce hydrogen;

an anode flow path through which an anode solution containing water and a metal ion flows, the anode flow path facing on the anode;

a cathode flow path facing on the cathode;

an electrolyte membrane provided between the anode and the cathode;

an anode supply flow path connected to an inlet of the anode flow path;

an anode discharge flow path connected to an outlet of the anode flow path;

a circulation flow path branching into a first circulation flow path and a second circulation flow path, the first circulation flow path connecting the anode supply flow path and the anode discharge flow path, and the second circulation flow path connected in parallel with the first circulation flow path;

an ion filter provided in a middle of the second circulation flow path and configured to remove some of the metal ion in the anode solution, the first circulation flow path being connected to the anode supply flow path without the ion filter, and the second circulation flow path being connected to the anode supply flow path via the ion filter;

a metal supply source configured to supply the metal ion into the anode solution;

a metal supply flow path connecting the metal supply source and the anode supply flow path;

a first valve provided in a middle of the first circulation flow path;

a second valve provided in a middle of the second circulation flow path;

a third valve provided in a middle of the metal supply flow path;

a sensor configured to measure a concentration of the metal ion in the anode solution from the anode flow path; and a controller configured to control opening and closing of the first valve, opening and closing of the second valve, and opening and closing of the third valve, according to the measured concentration of the metal ion, wherein the controller is configured to control a first operation to open the first valve and the third valve and close the second valve when the measured concentration of the metal ion is less than 0.05 μmol/l, a second operation to open the second valve and close the first valve and the third valve when the measured concentration of the metal ion exceeds 0.5 μmol/l, and a third operation to open the first valve and close the second valve and the third valve when the measured concentration of the metal ion is 0.05 μmol/l or more and 0.5 μmol/l or less.

2. The water electrolysis device according to claim 1, wherein the anode has a first anode catalyst layer containing metal.

3. The water electrolysis device according to claim 2, wherein the metal is at least one metal selected from the group consisting of nickel, iron, cobalt, and manganese.

4. The water electrolysis device according to claim 1, further comprising:

an anode flow path plate having the anode flow path, wherein the anode flow path plate having a second anode catalyst layer containing metal on an inner surface of the anode flow path.

5. The water electrolysis device according to claim 1, wherein the anode solution has a conductivity of 0.05 μS/cm or more and 0.7 μS/cm or less.

6. The water electrolysis device according to claim 1, wherein the concentration of the metal ion in the anode solution is adjusted to fall within a range of 0.05 μmol/l or more and 0.5 μmol/l or less.

7. The water electrolysis device according to claim 1, wherein the metal ion is at least one divalent ion selected from the group consisting of a nickel ion, an iron ion, a cobalt ion, and a manganese ion.

8. The water electrolysis device according to claim 1, wherein the sensor includes a high-frequency inductively coupled plasma emission spectroscopy sensor, an ion chromatograph, an ion concentration meter, an absorbance sensor, or a conductivity meter.

9. The water electrolysis device according to claim 1, wherein the ion filter includes a filter having a reverse osmosis membrane or a filter having a activated carbon and an ion exchange resin.

10. A method of controlling a water electrolysis device, the water electrolysis device comprising:

an anode configured to oxidize water to produce oxygen;

a cathode configured to reduce a hydrogen ion to produce hydrogen;

an anode flow path through which an anode solution containing water and a metal ion flows, the anode flow path facing on the anode;

a cathode flow path facing on the cathode;

an electrolyte membrane provided between the anode and the cathode;

an anode supply flow path connected to an inlet of the anode flow path;

an anode discharge flow path connected to an outlet of the anode flow path;

a circulation flow path branching into a first circulation flow path and a second circulation flow path, the first circulation flow path connecting the anode supply flow path and the anode discharge flow path, and the second circulation flow path connected in parallel with the first circulation flow path;

an ion filter provided in a middle of the second circulation flow path and configured to remove some of the metal ion in the anode solution, the first circulation flow path being connected to the anode supply flow path without the ion filter, and the second circulation flow path being connected to the anode supply flow path via the ion filter;

a metal supply source configured to supply the metal ion to the anode solution;

a metal supply flow path connecting the metal supply source and the anode supply flow path;

a first valve provided in a middle of the first circulation flow path;

a second valve provided in a middle of the second circulation flow path; and a third valve provided in a middle of the metal supply flow path;

the method comprising:

measuring a concentration of the metal ion in the anode solution from the anode flow path; and controlling opening and closing of the first valve, opening and closing of the second valve, and opening and closing of the third valve, according to the measured concentration of the metal ion, the method further comprising:

opening the first valve and the third valve and closing the second valve when the measured concentration of the metal ion is less than 0.05 μmol/l;

opening the second valve and closing the first valve and the third valve when the measured concentration of the metal ion is larger than 0.5 μmol/l; and opening the first valve and closing the second valve and the third valve when the measured concentration of the metal ion is 0.05 μmol/l or more and 0.5 μmol/l or less.

11. The method according to claim 10, further comprising:

controlling the opening and closing of the first valve, the opening and closing of the second valve, and the opening and closing of the third valve, to adjust the concentration of the metal ion in the anode solution to fall within a range of 0.05 μmol/l or more and 0.5 μmol/l or less.

12. The method according to claim 10, further comprising supplying the anode solution to the anode flow path and applying a voltage between the cathode and the anode, to oxidize the water and thus produce the hydrogen ion and to reduce the hydrogen ion and thus produce the hydrogen, wherein when the measured concentration of the metal ion is less than 0.05 μmol/l, the application of the voltage is stopped, when the measured concentration of the metal ion is larger than 0.5 μmol/l, the application of the voltage is stopped, and when the measured concentration of the metal ion is 0.05 μmol/l or more and 0.5 μmol/l or less, the application of the voltage is continued.

13. The method according to claim 10, wherein the anode solution has a conductivity of 0.05 μS/cm or more and 0.7 μS/cm or less.

14. The method according to claim 10, wherein the metal ion is at least one divalent ion selected from the group consisting of a nickel ion, an iron ion, a cobalt ion, and a manganese ion.

15. A water electrolysis device comprising:

a membrane electrode assembly comprising an anode configured to oxidize water to produce oxygen, the anode containing iridium, a cathode configured to reduce a hydrogen ion to produce hydrogen, the cathode containing platinum, and an electrolyte membrane provided between the anode and the cathode;

an anode flow path through which an anode solution containing water and at least one metal ion flows, the anode flow path facing on the anode, and the at least one metal ion being selected from the group consisting of a nickel ion, an iron ion, a cobalt ion, and a manganese ion;

a cathode flow path facing on the cathode;

an anode supply flow path connected to an inlet of the anode flow path;

an anode discharge flow path connected to an outlet of the anode flow path;

a circulation flow path branching into a first circulation flow path and a second circulation flow path, the first circulation flow path connecting the anode supply flow path and the anode discharge flow path, and the second circulation flow path connected in parallel with the first circulation flow path;

an ion filter provided in a middle of the second circulation flow path and configured to remove some of the at least one metal ion in the anode solution, the first circulation flow path being connected to the anode supply flow path without the ion filter, and the second circulation flow path being connected to the anode supply flow path via the ion filter;

a metal supply source configured to supply the at least one metal ion into the anode solution;

a metal supply flow path connecting the metal supply source and the anode supply flow path;

a first valve provided in a middle of the first circulation flow path;

a second valve provided in a middle of the second circulation flow path;

a third valve provided in a middle of the metal supply flow path;

a sensor configured to measure a concentration of the at least one metal ion in the anode solution from the anode flow path; and a controller configured to control opening and closing of the first valve, opening and closing of the second valve, and opening and closing of the third valve, according to the measured concentration of the at least one metal ion, wherein the controller is configured to control a first operation of opening the first valve and the third valve and closing the second valve when the measured concentration of the at least one metal ion is less than 0.05 μmol/l, a second operation of opening the second valve and closing the first valve and the third valve when the measured concentration of the at least one metal ion exceeds 0.5 μmol/l, and a third operation of opening the first valve and closing the second valve and the third valve when the measured concentration of the at least one metal ion is 0.05 μmol/l or more and 0.5 μmol/l or less.

16. The water electrolysis device according to claim 15, wherein the anode has a first anode catalyst layer containing metal.

17. The water electrolysis device according to claim 16, wherein the metal is at least one metal selected from the group consisting of nickel, iron, cobalt, and manganese.

* * * * *